US005337123A

United States Patent [19]

Fisher

[11] Patent Number: 5,337,123

[45] Date of Patent: Aug. 9, 1994

[54] BELT SUPPORTING MEMBER FOR A COLOR IMAGE FORMING APPARATUS

[75] Inventor: Donald J. Fisher, Pittsford, N.Y.

[73] Assignee: Xerox Corporation, Stamford, Conn.

[21] Appl. No.: 977,373

[22] Filed: Nov. 19, 1992

[51] Int. Cl.[5] ..... G03G 15/01; G03G 5/00

[52] U.S. Cl. ..... 355/212; 355/273; 355/327

[58] Field of Search ..... 355/326, 327, 212, 213, 355/271, 273

[56] References Cited

U.S. PATENT DOCUMENTS

| | | | |
|---|---|---|---|
| 3,392,667 | 7/1968 | Cassel et al. | 101/170 |
| 3,399,611 | 9/1968 | Lusher | 95/1.7 |
| 4,174,171 | 11/1979 | Hamaker et al. | 355/212 |
| 4,627,702 | 12/1986 | Anderson | 355/212 |
| 4,657,370 | 4/1987 | Forbes, II et al. | 355/212 |
| 4,751,549 | 6/1988 | Koizumi | 355/327 |
| 4,769,672 | 9/1988 | Hoshi et al. | 355/212 X |
| 4,969,012 | 11/1990 | Suzuki et al. | 355/212 |
| 5,017,969 | 5/1991 | Mitomi et al. | 355/212 X |

*Primary Examiner*—A. T. Grimley
*Assistant Examiner*—Nestor R. Ramirez
*Attorney, Agent, or Firm*—R. Zibelli; J. E. Beck; H. Fleischer

[57] ABSTRACT

A single pass tandem architecture electrophotographic printing machine in which a photoconductive belt is supported by a plurality of spaced, stationary and arcuate members for transferring each color image from the photoconductive belt in registration with one another and having minimum registration errors from mechanical apparatus. Each of the latent images recorded on the photoreceptor belt is developed with different color developer material. The different color developed images are transferred from the photoconductive belt to a sheet of support material in superimposed registration with one another to print the desired multicolor information thereon.

9 Claims, 2 Drawing Sheets

BELT SUPPORTING MEMBER FOR A COLOR IMAGE FORMING APPARATUS

Figure 1:
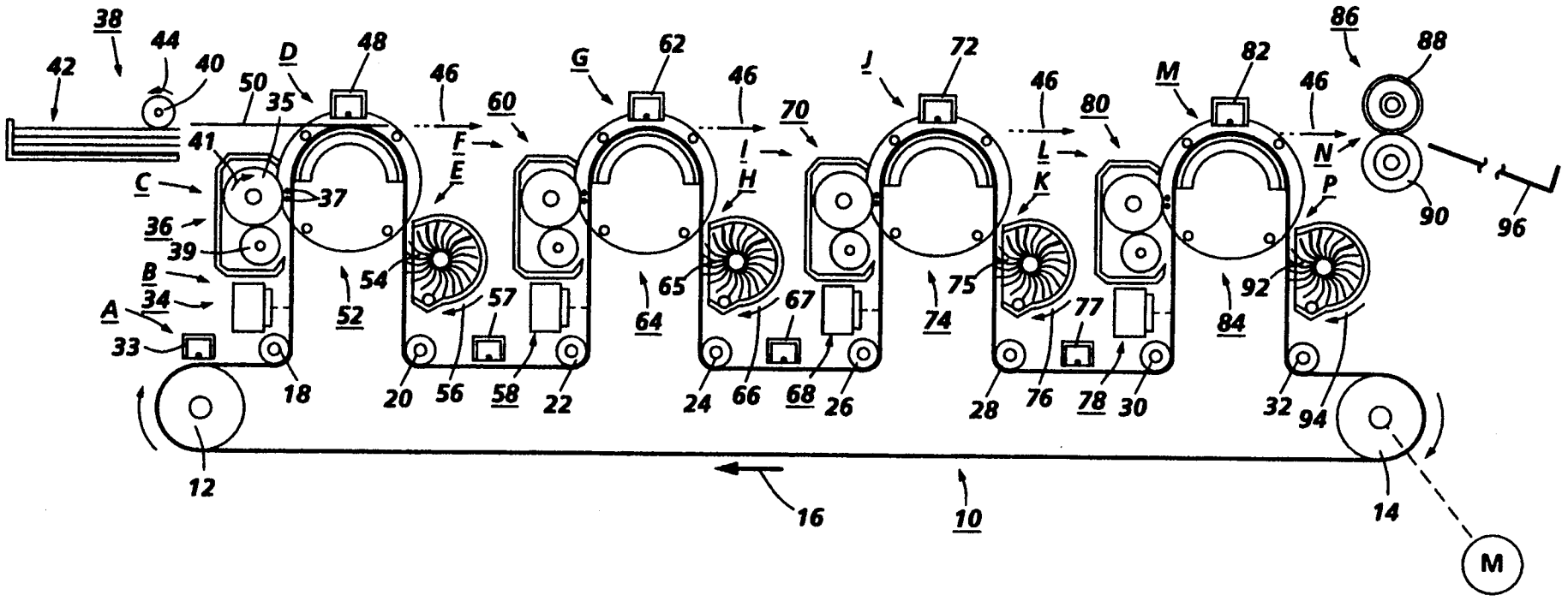

This invention relates generally to multicolor printing in an electrostatic printing machine. More particularly, the invention relates to an apparatus and a plurality of differently colored images that are printed successively in register to form a final multicolor image in a single pass.

Hereinbefore, tandem multicolor copying was achieved by transferring successive toner powder images from photoconductive drums to an intermediate member in superimposed registration with one another and then to a sheet of copy paper. Such a system may use three or four photoconductive drums depending on whether black is treated as a fourth color. In one method, each photoconductive surface is charged to a substantially uniform potential and image-wise exposed to record electrostatic latent images corresponding to the three or four color components of the document being produced. Thus, the electrostatic latent image on each photoconductive surface corresponds to one color separation of the document. Thereafter, different color developer is transported into contact with the electrostatic latent images. The developer may consist of liquid or powder material. In the case of a powder material, toner particles are transferred from carrier granules in the developer material to the latent images. The resultant toner powder images are then sequentially transferred from each photoconductive surface to an intermediate member or directly to a single copy sheet and affixed thereto.

Various other approaches have been devised to produce multicolor color copies. The following disclosures appear to be relevant:

U.S. Pat. No. 3,392,667, Patentee: Cassel et al., Issued: Jul. 16, 1968.

U.S. Pat. No. 3,399,611, Patentee: Lusher, Issued: Sep. 3, 1968.

The disclosures of the above-identified patents may be briefly summarized as follows:

U.S. Pat. No. 3,392,667 discloses a plurality of print cylinders having gravure engravings on their peripheries. Powder feed hoppers having rotating brushes apply powder to the print cylinders. The powder images from the print cylinders are transferred to an offset roller in superimposed registration with one another. The resultant powder image is then transferred from the offset roller to paper or sheeting.

U.S. Pat. No. 3,399,611 describes four image transfer stations located in a linear alignment opposite a moving belt. Each image transfer station is basically the same and includes a photoconductive drum charged by a charging wire and then rotated into alignment with an image exposure station to record a latent image thereon. The appropriately colored powder toner particles are then cascaded across the latent image to develop it, and the powder images are then transferred to the surface of the belt in registration. The completed powder image is then permanently fixed to the belt which is then wound on a take up roll.

In accordance with the features of the present invention, there is provided a printing machine for developing a plurality of different color images on a photoconductive belt and transferring the color images, in superimposed registration, with one another, to a sheet of support material. The improvement in the printing machine includes a plurality of arcuate members adapted to support the photoconductive belt. Each of the plurality of arcuate members are spaced apart from one another and are in contact with the photoconductive belt to provide the support thereof. A plurality of transfer devices are provided, and with one of the plurality of transfer devices being positioned adjacent one of the arcuate members with the photoconductive belt being interposed therebetween to define a plurality of transfer regions with one of the color images being transferred, at one of the transfer regions, from the photoconductive belt to the sheet of support material in superimposed registration with the other color images transferred thereto forming a multicolor image on the sheet of support material.

Figure 2:
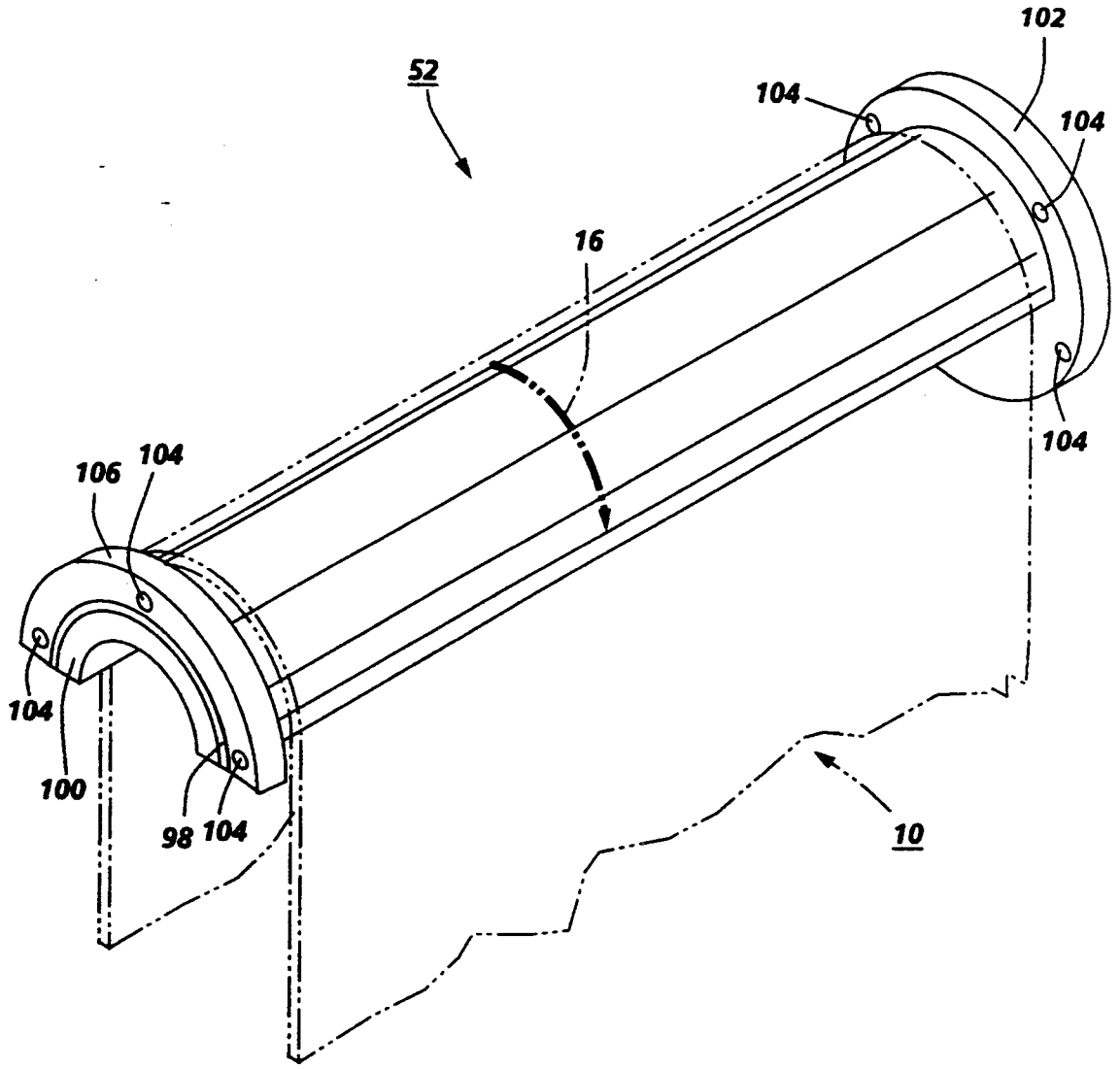

Other aspects of the present invention will become apparent from the following description and upon reference to the drawings, in which:

FIG. 1 is a schematic elevational view depicting an illustrative electrophotographic printing machine incorporating the inventive features of the present invention therein in which a photoconductive belt is entrained about a plurality of spaced, arcuate members; and FIG. 2 is a fragmentary, perspective view of one of the arcuate members of the printing machine of FIG. 1.

While the present invention will hereinafter be described in conjunction with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to designate identical elements. FIG. 1 schematically depicts the various components of a printing machine incorporating the features of the present invention therein. It will become evident from the following discussion that the features of the present invention are equally well suited for use in a wide variety of electrostatic printing machines and are not necessarily limited in their application to the particular embodiment depicted herein.

Inasmuch as the various art of electrostatic printing is well known, the various processing stations employed in the FIG. 1 printing machine will be shown hereinafter and their operation described briefly with reference thereto.

Turning now to FIG. 1, the printing machine employs an endless photoconductive belt, indicated by the reference numeral 10, on which a plurality of electrostatic latent images are recorded. Belt 10 is supported on opposite ends of the belt loop by two rollers 12 and 14. Roller 14 is rotatively driven by a suitable motor M to move belt 10 in the direction of arrow 16. Rolls 18, 20, 22, 24, 26, 28, 30 and 32 are idler rolls provided to keep photoconductive belt 10 taut and on track in the inter-imaging loops of the photoreceptor belt 10. The same function can be accomplished with a plurality of vacuum plenums (not shown) approximately located in the inter-image areas of photoreceptor belt 10 and replacing idler rolls 18, 20, 22, 24, 26, 28, 30 and 32.

Initially, the photoconductive belt 10 is driven in the direction of arrow 16 so that a portion of the belt passes through charging station A. At charging station A, a corona generating device, indicated generally by reference numeral 33, charges photoreceptor belt 10 to a relatively high, substantially uniform potential.

Next, the charged portion of the photoreceptor belt is advanced through imaging station B. At imaging station B, the uniformly charged photoreceptor surface is exposed by an image print bar 34. The print bar generally consists of a plurality of discrete light emitting diodes (LED). In order to achieve high resolution, a large number of light emitting diodes are arranged in a linear array extending across the width of photoconductive belt 10. As belt 10 moves in the direction of arrow 16, successive portions of the photosensitive surface are exposed creating the desired latent image one line at a time. Each LED in the linear array illuminates a corresponding area on the surface of photoconductive belt 10 to an exposure level defined by video data information applied to the drive circuit of the print bar.

When forming a multicolor copy, a plurality or, as shown herein, four electrostatic latent images are recorded on the surface of photoconductive belt 10. The electrostatic latent image recorded on the surface of photoconductive belt 10 imaging station is advanced to development station C as belt 10 moves in the direction of arrow 16.

At development station C, the latent image is developed by developer unit 36. By way of example, developer unit 36 has toner particles corresponding to the first subtractive primary color. Developer unit 36, which is representative of the operation of development units 60, 70 and 80, includes a donor roll 35, electrode wires 37 and a magnetic roll 39. The donor roll 35 can be rotated in either direction relative to the motion of photoconductive belt 10. The donor roll is shown rotating in the direction of arrow 41. Electrode wires 37 are located in the development zone defined as the space between photoconductive belt 10 and donor roll 35. The distance between wires 37 and donor roll 35 is approximately the thickness of the toner layer on donor roll 35. A voltage source electrically biases the electrode wires with both a DC potential and an AC potential. A DC voltage source establishes an electrostatic field between photoconductive belt 10 and donor roll 35. In operation, magnetic roll 39 advances developer material comprising carrier granules and toner particles to a loading zone adjacent donor roll 35. The electrical bias between donor roll 35 and magnetic roll 39 causes the toner particles to be attracted from the carrier granules to donor roll 35. Donor roll 35 advances the toner particles to the development zone. The electrical bias on electrode wires 37 detaches the toner particles from donor roll 35 and forms a toner powder cloud in the development zone. The latent image attracts the detached toner particles, i.e. one of the subtractive colors, cyan, magenta, yellow, or black, to form a first subtractive primary color toner powder image thereon.

After development of the latent image with the first color toner, for example cyan, photoconductive belt 10 continues to move in the direction of arrow 16 to transfer station D. In the area comprising the transfer zone, there is a photoconductive belt supporting member indicated generally by the reference numeral 52. Support member 52 is a permanent precision surface adapted to form an extended transfer region over which the photoconductive belt 10 is drawn.

At transfer station D, a sheet of support material 50 is moved into contact with the cyan image developed on photoconductive belt 10. The sheet of support material 50 is advanced to the transfer station D by a sheet feeding apparatus, indicated generally by the reference numeral 38. Preferably, sheet feeding apparatus 38 includes a feed roll 40 contacting the uppermost sheet of a stack of sheets 42. Feed roll 40 rotates in the direction of arrow 44 to advance the uppermost sheet of support material to a conveyor, such as a vacuum transport (not shown).

Accurate registration of the image developed on photoconductive belt 10 with the sheet of support material is achieved by synchronizing the motion of the sheet transport with the movement of the photoconductive belt. This may be accomplished by driving the sheet transport with a servo motor (not shown) that is in a timed synchronism with motor M which moves photoconductive belt 10 in the direction of arrow 16. As the developed image on photoconductive belt 10 moves to the transfer station D, the servo motor decelerates such that the photoconductive belt and the sheet of support material have substantially the same tangential velocity in the transfer zone with both the sheet of support material 50 and developed image arriving simultaneously thereat.

Preferably, transfer station D includes a corona generating device 48. Corona generating device 48 sprays ions onto the backside of the sheet of support material. This attracts the cyan toner image from the surface of photoconductive belt 10 to sheet 50. After transfer, sheet 50 continues to move in the direction of arrow 46 on a conveyor (not shown) to successive transfer stations in synchronism with consecutive images developed on the photoconductive belt. Once the first image is transferred to sheet 50, the velocity of the conveyor is adjusted to insure that the next image on the photoconductive belt and the sheet of support material 50 arrive at the next transfer region simultaneously in superimposed registration with each other. In this way, successive developed images are transferred to the sheet of support material 50.

After the developed image is transferred, the photoconductive belt 10 moves to cleaning station E. At cleaning station E, a cleaning brush 54 rotates in the direction of arrow 56 to remove the residual particles adhering to the surface of photoconductive belt 10. Thereafter, photoconductive belt 10 advances to the next charging station where a new charge is placed thereon by charging device unit 57.

A second latent image is recorded by an imaging unit 58 on another pitch of the photoreceptor belt 10. This latent image is developed at development station F by a developer unit 60 with toner particles of the second primary color, i.e. magenta toner particles. The second developed image is transferred to sheet support material 50 at transfer station G in the same manner by a support member 64 and a corona generating device 62, as previously discussed with regard to the first developed image. However, the second developed image is transferred to sheet 50 in superimposed registration over the first developed image. At cleaning station H, a cleaning brush 65 rotates in the direction of arrow 66 to remove the residual particles adhering to the surface of photoconductive belt 10 as it advances to the next station where subsequently a third charge is placed thereon by charging device 67. A third latent image is recorded by an imaging unit 68 on another pitch of photoreceptor belt 10. This latent image is developed at development station I by a developer unit 70 containing toner particles of the third primary color, i.e. yellow. The third developed image is transferred to sheet 50 at transfer station J by a support member 74 and a corona generating device 72. The third developed image is transferred to sheet 50 in superimposed registration with the first and second developed images.

After the third developed image is transferred, the photoconductive belt moves to cleaning station K where a cleaning brush 75 rotates in the direction of arrow 76 to remove residual particles from the surface of the photoconductive belt. The photoconductive belt advances to charging unit 77 wherein a fourth charge is placed upon the photoconductive surface. A fourth latent image is recorded by an imaging unit 78 on another pitch of the photoconductive belt and developed with developer material having the fourth color, in this example black toner particles, at station L. The developer unit at station K is generally indicated by reference numeral 80. At station M, the black developed image is transferred to sheet 50 at support member 84 and corona generator 82. The black developed image is transferred to the sheet in superimposed registration over the first, and second, and third developed images.

After transfer of the black developed image, support sheet 50 continues to move in the direction of arrow 46 onto a conveyor (not shown), which advances the sheet to fusing station N. Fusing station N includes a fuser assembly, indicated generally by the reference numeral 86, which permanently affixes the transferred powder images to the support sheet 50. Preferably, fuser assembly 86 includes a heated fuser roller 88 and back up roller 90 with the powdered images contacting fuser roller 88. In this manner, the powder images are permanently fused to support sheet 50. After fusing, forwarding rollers (not shown) advance the sheet to catch tray 96 for subsequent removal by the operator.

After support sheet 50 is separated from photoconductive belt 10, some residual toner particles in the image frame remain adhering thereto. The photoconductive belt 10 moves to cleaning station P where a cleaning brush 92 rotates in the direction of arrow 94 to remove the residual toner particles from the surface of the photoconductive belt 10 in preparation for the next imaging cycle.

One skilled in the art will appreciate that three developer units are used to process color documents. This type of system is a subtractive system employing cyan, magenta, and yellow developer units. It should also be clear that four developer units may be employed in a subtractive system using undercolor removal. This system employs black, cyan, magenta and yellow developer units.

FIG. 2 illustrates a fragmentary, perspective view of the arcuate shoe 52 in FIG. 1. Since all of the arcuate shoes 52, 64, 74 and 84 are identical, a detailed description of arcuate shoe 52 will only be described. Referring to FIG. 2, it will be seen that the arcuate shoe 52 comprises a simply supported metal core 100 which is formed from a suitable hard material, such as steel. Flanges 102 and 106 provide the mounting for attaching the shoe to the walls (not shown) of the electrostatic printing machine via holes 104. Flanges 102 and 106 prevent lateral movement of the photoconductive belt 10 that is orthogonal to the direction of arrow 16.

Typically, the frictional contact portion 98, over which photoconductive belt 10 is entrained, may have a Teflon® coating of about 2 to 5 mils to provide a low friction surface for supporting the photoconductive belt. Alternatively, the low friction coating of the contact portion 98 can be replaced by a perforated structure to form an air bearing to prevent excessive drag.

By supporting the photoconductive belt, at each of the four U-shaped inter-imaging loops on arcuate members, each developed image will be transferred successively in register to a single sheet. Generally, the main cause of misregistration is due to the nonuniform radii or out-of-roundness of the photoconductive belt at the ends of the belt loop. The out-of-roundness results in a variable imaging speed which produces images of different lengths and distortions for different colors. Thus, the arcuate members support the photoconductive belt at each U-shaped inter-imaging loop to maintain the photoconductive belt constant.

A printing machine of the present invention has been described that records electrostatic latent images on a photoconductive belt which is supported by a plurality of spaced arcuate members. The electrostatic latent images are subsequently developed with different colored developer material. The differently colored developed images are then transferred consecutively to a support sheet in superimposed registration with one another. The support sheet then passes through a fusing station where the differently colored developed images are permanently affixed thereto forming multicolored information on the sheet.

There has been provided, in accordance with the present invention, a printing machine that fully satisfies the aims and advantages hereinbefore set forth. While this invention has been described in conjunction with a preferred embodiment thereof, it is evident that many alternatives, modifications and variations fall within the spirit and broad scope of the appended claims.

What is claimed is:

1. A printing machine of the type in which a plurality of different color images developed on a photoconductive belt are transferred to a sheet of support material in superimposed registration with one another, wherein the improvement includes:

a plurality of stationary arcuate members adapted to support the photoconductive belt, each of said plurality of arcuate members, including a fixedly supported curved surface, being spaced from one another and in contact with the photoconductive belt to provide support therefor; and a plurality of transfer devices with one of said plurality of transfer devices being positioned opposite the curved surface of one of said stationary arcuate member with the photoconductive belt being interposed therebetween to define a plurality of transfer regions with one of the color images being transferred, at one of the transfer regions, from the photoconductive belt to the sheet of support material in superimposed registration with the other color images transferred thereto forming a multicolor image on the sheet of support material.

2. A printing machine according to claim 1, further including:

means for recording a plurality of electrostatic latent images on the photoconductive belt in image-wise patterns; and means for developing each of the electrostatic latent images recorded on the photoconductive belt with different color developer material to form the plurality of developed images.

3. A printing machine according to claim 2, further including means for permanently fusing the multicolor developed image to the sheet of support material.

4. A printing machine according to claim 3, further including means for successively removing developer material from the photoconductive belt after the photoconductive belt exits from each transfer region.

5. A printing machine according to claim 4, wherein said developing means develops each of the electrostatic latent images with developer material selected from the group consisting of cyan developer material, magenta developer material, yellow developer material, and black developer material with each electrostatic latent image being developed with a different color developer material.

6. A printing machine according to claim 5, wherein each of said plurality of transfer devices includes a corona generating device adapted to charge the sheet of support material so that the charge thereon attracts the developed image from the photoconductive belt to the sheet of support material.

7. A printing machine according to claim 6, wherein said recording means includes:

a corona generating device adapted to electrostatically charge the photoconductive belt to a relatively high, substantially uniform charge; and means for exposing the charged portion of the photoconductive belt to record the latent images thereon.

8. A printing machine according to claim 7, wherein said arcuate member includes a flange disposed at each end thereof to provide a tracking guide for the photoconductive belt.

9. A printing machine according to claim 8, further including means for supporting the photoconductive belt to form a plurality of U-shaped regions with each of the U-shaped regions being spaced from one another.

* * * * *